US011795661B2

(12) United States Patent
Sahlman et al.

(10) Patent No.: US 11,795,661 B2
(45) Date of Patent: Oct. 24, 2023

(54) METHOD OF CONTROLLING A ROTATABLE LOAD, A HYDRAULIC SYSTEM AND A WORKING MACHINE

(71) Applicants: Volvo Construction Equipment AB, Eskilstuna (SE); Norrhydro Oy, Rovaniemi (FI)

(72) Inventors: Mika Sahlman, Tampere (FI); Kim Heybroek, Kvicksund (SE)

(73) Assignee: VOLVO CONSTRUCTION EQUIPMENT AB, Eskilstuna (SE)

( * ) Notice: Subject to any disclaimer, the term of this patent is extended or adjusted under 35 U.S.C. 154(b) by 118 days.

(21) Appl. No.: 17/612,875

(22) PCT Filed: May 21, 2019

(86) PCT No.: PCT/EP2019/063094
§ 371 (c)(1),
(2) Date: Nov. 19, 2021

(87) PCT Pub. No.: WO2020/233793
PCT Pub. Date: Nov. 26, 2020

(65) Prior Publication Data

US 2022/0220702 A1 Jul. 14, 2022

(51) Int. Cl.
*E02F 9/22* (2006.01)
*E02F 9/12* (2006.01)
*F15B 13/02* (2006.01)

(52) U.S. Cl.
CPC ..... *E02F 9/2235* (2013.01); *E02F 9/123* (2013.01); *E02F 9/2228* (2013.01);
(Continued)

(58) Field of Classification Search
CPC ..... E02F 9/2232; E02F 9/2235; E02F 9/2253; E02F 9/2296; F16H 61/4061; F16H 61/42;
(Continued)

(56) References Cited

U.S. PATENT DOCUMENTS 5,323,611 A * 6/1994 Kotake ..... F16H 61/47 60/449
5,784,883 A * 7/1998 Ohkura ..... E02F 9/2253 60/449
(Continued)

FOREIGN PATENT DOCUMENTS

CN 105264149 A 1/2016
JP 2000249225 A 9/2000
(Continued)

OTHER PUBLICATIONS

International Search Report and Written Opinion of the International Searching Authority, PCT/EP2019/063094, dated Jan. 27, 2020, 16 pages.
(Continued)

*Primary Examiner* — Michael Leslie
(74) *Attorney, Agent, or Firm* — Sage Patent Group

(57) ABSTRACT

A method of controlling a rotatable load by a hydraulic system, the method includes determining if the hydraulic system is in a first operating state or a second operating state; controlling the rotatable load in a valve control mode if the hydraulic system is in the first operating state, the valve control mode including controlling the rotatable load by controlling a valve arrangement; controlling the rotatable load in a displacement control mode if the hydraulic system is in the second operating state, the displacement control mode including controlling the rotatable load mainly by controlling the displacement of a hydraulic machine; and applying a non-zero absolute minimum displacement limi-
(Continued)

tation to the hydraulic machine at least in the valve control mode.

24 Claims, 8 Drawing Sheets

(52) U.S. Cl.
CPC ..... *E02F 9/2296* (2013.01); *F15B 13/02* (2013.01); *E02F 9/2267* (2013.01); *E02F 9/2292* (2013.01)

(58) Field of Classification Search
CPC ..... F16H 61/423; F16H 61/425; F16H 61/47; F16H 61/472; F16H 61/475
See application file for complete search history.

(56) References Cited

U.S. PATENT DOCUMENTS 6,182,448 B1 * 2/2001 Ohkura ..... F16H 61/47 60/494
9,140,275 B2 * 9/2015 Dengler ..... F16H 61/47
9,506,222 B2 * 11/2016 Britten ..... F16H 61/421
9,850,918 B2 12/2017 Morelius et al.
10,919,514 B2 * 2/2021 Lang ..... F16H 61/47
2012/0180470 A1 7/2012 Schroeder et al.
2013/0000290 A1 1/2013 Zhang et al.
2013/0098011 A1 4/2013 Knussman et al.
2014/0007565 A1 1/2014 Yamashita et al.
2017/0073933 A1 3/2017 Tanaka et al.

FOREIGN PATENT DOCUMENTS

WO 2013025459 A1 2/2013
WO 2017106536 A1 6/2017

OTHER PUBLICATIONS

Chinese First Office Action dated Jul. 13, 2022 for Chinese Patent Application No. 201980096668.1, 25 pages (including English translation).

* cited by examiner

METHOD OF CONTROLLING A ROTATABLE LOAD, A HYDRAULIC SYSTEM AND A WORKING MACHINE

CROSS REFERENCE TO RELATED APPLICATIONS

This application is a 35 U.S.C. § 371 national stage application of PCT International Application No. PCT/EP2019/063094 filed on May 21, 2019, the disclosure and content of which is incorporated by reference herein in its entirety.

TECHNICAL FIELD

The invention relates to a method of controlling a rotatable load by a hydraulic system, a hydraulic system for controlling a rotatable load, and a working machine.

The invention is applicable on hydraulic systems of working machines within the fields of industrial construction machines, material handling machines or construction equipment, in particular wheel loaders and excavators. Although the invention will be described with respect to an excavator, the invention is not restricted to this particular machine, but may be used in any working machine comprising a hydraulic system with a high-pressure side and a low-pressure side, such as wheel loaders, articulated or rigid haulers and backhoe loaders.

BACKGROUND

Hydraulic systems are used in a wide range of applications. For example, working machines typically rely on hydraulic systems to provide power for handling loads. A hydraulic system for a working machine may comprise various hydraulic actuators, for example hydraulic cylinders and rotary hydraulic machines. Hydraulic cylinders may for example be provided in a working device comprising arms and a bucket. Rotary hydraulic machines may for example be used for propulsion of a working machine and/or for a swing function of an excavator. Hydraulic hybrid systems can be used to recuperate energy from the hydraulic actuators and use it later to reduce the loading of an internal combustion engine.

Hydraulic systems comprising a dedicated high-pressure side and a dedicated low-pressure side may be referred to as dual pressure hydraulic systems, and are previously known as such. Dual pressure hydraulic systems typically comprise one or more high-pressure accumulators connected to a high-pressure side, and one or more low-pressure accumulators connected to a low-pressure side. Advantages associated with dual pressure hydraulic systems are for example improved energy efficiency and controllability.

US 2013098011 A1 discloses a hydraulic system having a first circuit fluidly connecting a first pump to a swing motor in a closed-loop manner, and a second circuit fluidly connecting a second pump to a first travel motor and a first linear tool actuator in a parallel closed-loop manner. The hydraulic system may also have a combining valve configured to selectively fluidly connect the first circuit to the second circuit.

SUMMARY

An object of the invention is to provide a method of controlling a rotatable load of a hydraulic system, which method is energy efficient, accurate, simple and/or cheap and enables an energy efficient, simple and/or cheap hydraulic system.

According to a first aspect of the invention, the object is achieved by a method of controlling a rotatable load according to claim 1. The method is carried out in a hydraulic system comprising a high-pressure side; a low-pressure side; a variable displacement hydraulic machine for rotationally driving the rotatable load; and a valve arrangement in fluid communication with the high-pressure side, the low-pressure side, a first side of the hydraulic machine, and a second side of the hydraulic machine. The method comprises determining if the hydraulic system is in a first operating state or a second operating state, the determination being based at least on one of a commanded or actual rotational speed of the hydraulic machine, a commanded or actual torque of the hydraulic machine, and/or a commanded or actual power of the hydraulic machine; controlling the rotatable load in a valve control mode if the hydraulic system is in the first operating state, the valve control mode comprising controlling the rotatable load by controlling the valve arrangement; controlling the rotatable load in a displacement control mode if the hydraulic system is in the second operating state, the displacement control mode comprising controlling the rotatable load mainly by controlling the displacement of the hydraulic machine; and applying a non-zero absolute minimum displacement limitation to the hydraulic machine at least in the valve control mode.

The method enables the use of a relatively cheap two-quadrant hydraulic machine instead of a relatively expensive four-quadrant hydraulic machine. The method can however also be carried out with a four-quadrant hydraulic machine.

At high rotational speeds, high power operations, and/or high torque operations of the hydraulic machine, energy losses over the valve arrangement may be relatively high if the rotatable load is controlled to a large extent by controlling the valve arrangement. Throttling over the valve arrangement may therefore be reduced or eliminated in the displacement control mode. Thereby, energy losses over the valve arrangement are reduced or eliminated. In the valve control mode however, i.e. at low rotational speeds, low power operations and/or low torque operations of the hydraulic machine, the energy losses over the valve arrangement are relatively low.

In case an over-center four quadrant hydraulic machine is used in a dual pressure hydraulic system without a valve arrangement between the high-pressure side/low-pressure side and the hydraulic machine, it may be difficult to control the rotatable load at start-up by means of only displacement control, for example due to mechanical play between the hydraulic machine and the rotatable load, such as in an intermediate gearbox. The displacement may thereby initially be increased "within the play" without the hydraulic machine generating any substantial torque until the hydraulic machine "hits" a driven part as the backlash is eliminated.

Furthermore, in case an over-center four quadrant hydraulic machine is used in a dual pressure hydraulic system without a valve arrangement between the high-pressure side/low-pressure side and the hydraulic machine, the hydraulic machine needs to be positioned in zero displacement at start-up in order to not generate a torque. During start-up of a hydraulic system under the control of the method according to the invention in contrast, the displacement of the hydraulic machine can be arbitrary (for example 100%) since the valve control mode will be active during start-up. By means of the valve control mode, the main pressure drop may be over the valve arrangement at start-up.

Conversely, the method according to the invention also enables stopping of the rotatable load with an arbitrary displacement of the hydraulic machine by means of the valve arrangement. For an over-center four quadrant hydraulic machine used in a dual pressure hydraulic system without a valve arrangement between the high-pressure side/low-pressure side and the hydraulic machine in contrast, the displacement of the hydraulic machine needs to be brought to zero when the rotatable load is stopped.

The valve control mode comprises controlling the rotatable load by controlling a flow through the valve arrangement. Thus, in the valve control mode, the valve arrangement is involved to control the rotatable load. In the valve control mode, the valve arrangement may therefore be said to operate as a flow source. Although the valve control mode comprises control of the rotatable load by controlling the valve arrangement, the valve control mode may also comprise control of the rotatable load by controlling the displacement of the hydraulic machine. For example, in the valve control mode, a pressure drop over the hydraulic machine may constitute up to 50% of the pressure difference between the high-pressure side and the low-pressure side. In the valve control mode, the displacement of the hydraulic machine may either be constant or variable.

In the displacement control mode, the pressure at the first side/second side may be at least 60%, such as at least 75%, such as at least 90% of the pressure in the high-pressure side in case a fluid communication is established from the high-pressure side to the first side/second side by means of the valve arrangement. Alternatively, or in addition, a pressure drop over the hydraulic machine may constitute at least 60%, such as at least 70%, such as at least 80% of the pressure difference between the high-pressure side and the low-pressure side in the displacement control mode. In this way, the rotatable load is mainly controlled by controlling the displacement of the hydraulic machine.

In the displacement control mode, the valve arrangement may be controlled to provide a maximum pressure drop over the hydraulic machine. Thereby, a torque requested by the hydraulic machine, e.g. based on an error signal in a feedback loop, can be reached by controlling the displacement. The displacement control mode may comprise secondary control of the hydraulic machine.

According to one example, the rotatable load is controlled by only controlling the displacement of the hydraulic machine in the displacement control mode, e.g. while maintaining an opening area of each valve of the valve arrangement constant. The valve arrangement may thereby be said to operate as a pressure source in the displacement control mode. For example, each valve of the valve arrangement may be fully open, or open as much as possible, in the displacement control mode in order to establish a smallest possible pressure drop over the valve arrangement. In the valve control mode, the rotatable load may be controlled by controlling both the valve arrangement and the displacement of the hydraulic machine. The valve control mode may thus comprise a blended or mixed control of the valve arrangement and the displacement of the hydraulic machine.

In the valve control mode, the pressures at the first side and the second side may be said to be coupled to the rotatable load. In the displacement control mode, the pressures at the first side and the second side may be said to be decoupled from the rotatable load.

A non-zero absolute minimum displacement limitation may for example be 5-100%, for example 10%. In case the hydraulic machine has a variable displacement of −100%-0%, the displacement limitation may be set to −10%. The absolute minimum displacement limitation is in this case 10%. The displacement limitation, or a different non-zero absolute minimum displacement limitation, may or may not be applied also in the displacement control mode.

The non-zero absolute minimum displacement limitation may be applied by software, e.g. by a control system as described herein. Alternatively, the non-zero absolute minimum displacement limitation may be applied by hardware, e.g. by using an irreversible hydraulic machine with a built-in minimum displacement.

As a further example, a non-zero absolute minimum displacement limitation may be 100%. Thereby, the hydraulic machine is forced to a maximum displacement in the first operating state, i.e. at low rotational speeds, low power operations and/or low torque operations.

The high pressure in the high-pressure side is higher than the low pressure in the low-pressure side during operation of the hydraulic system. The pressures in the high-pressure side and the low-pressure side are not limited to any specific pressure values. Rather, the terminologies "high pressure" and "low pressure" indicate that these pressure levels are different and that the high pressure is higher than the low pressure. The pressure levels in the high-pressure side and the low-pressure side are selected depending on each configuration. The pressure levels in the high-pressure side and the low-pressure side may vary during operation of the hydraulic system.

The high-pressure side may be referred to as a primary side or primary source of hydraulic power arranged to both produce and receive a volume flow at a first pressure level and the low-pressure side may be referred to as a secondary side or secondary source of hydraulic power arranged to both produce and receive a volume flow at a second pressure level, lower than the first pressure level.

According to one embodiment, the displacement limitation in the valve control mode and/or a displacement of the hydraulic machine in the valve control mode, is at least 60%, such as at least 80%, such as 100%. For example, in case the displacement limitation is set to 80% in the valve control mode, the displacement may be held constant at any value between 80% and 100%, or may vary between 80% and 100%. In this embodiment, the determination if the hydraulic system is in the first operating state or the second operating state may be made based only on one of a commanded or actual rotational speed of the hydraulic machine, a commanded or actual torque of the hydraulic machine, and/or a commanded or actual power of the hydraulic machine. In this embodiment, a required displacement, as described herein, does not have to be determined in order to decide whether the hydraulic system is in the first operating state or the second operating state. However, a required displacement may nevertheless be determined and used in the displacement control mode. In this embodiment, the displacement of the hydraulic machine may be constant in the valve control mode.

Furthermore, this embodiment may comprise a stepwise transition between the valve control mode and the displacement control mode. For example, when the rotational speed of the hydraulic machine increases to over a second speed threshold value (e.g. 300 rpm), it may be determined that the hydraulic system enters the second operating state and the valve control mode is switched stepwise to the displacement control mode, e.g. over a 300 ms time period. In the displacement control mode, the displacement limitation may be maintained, reduced or eliminated. When the rotational speed of the hydraulic machine decreases to below a first speed threshold value (e.g. 200 rpm) lower than the second speed threshold value, it may be determined that the hydraulic system again enters the first operating state and the displacement control mode is switched stepwise to the valve control mode, e.g. over a 300 ms time period.

According to one embodiment, the method further comprises applying the displacement limitation to the hydraulic machine at least when a rotational speed of the hydraulic machine is below a first speed threshold value, when a power of the hydraulic machine is below a first power threshold value, and/or when a torque of the hydraulic machine is below a first torque threshold value; determining a required displacement of the hydraulic machine based on a command for the hydraulic machine and a pressure drop over the hydraulic machine; determining that the hydraulic system is in the first operating state, if the required displacement is smaller than the displacement limitation of the hydraulic machine; and determining that the hydraulic system is in the second operating state, if the required displacement is larger than the displacement limitation of the hydraulic machine.

The method according to this embodiment may alternatively be defined as applying a non-zero absolute minimum displacement limitation to the hydraulic machine at least when a rotational speed of the hydraulic machine is below a first speed threshold value, when a power of the hydraulic machine is below a first power threshold value, and/or when a torque of the hydraulic machine is below a first torque threshold value; determining a required displacement of the hydraulic machine based on a command for the hydraulic machine and a pressure drop over the hydraulic machine; controlling the rotatable load by controlling the valve arrangement, if the required displacement is smaller than the displacement limitation of the hydraulic machine; and controlling the rotatable load mainly by controlling the displacement of the hydraulic machine, if the required displacement is larger than the displacement limitation of the hydraulic machine.

Throughout the present disclosure, the control of the rotatable load by controlling the valve arrangement may be referred to as a "valve control mode" and the control of the rotatable load mainly by controlling the displacement of the hydraulic machine may be referred to as a "displacement control mode". The switching between the valve control mode and the displacement control mode may be made by a continuous or repeated comparison between the required displacement and the displacement limitation. For example, in case the non-zero absolute minimum displacement limitation is 10%, the valve control is applied when the required displacement is below 10% and the displacement control is applied when the required displacement is above 10%.

The required displacement may for example be calculated based on the pressure drop over the hydraulic machine and a torque command to the hydraulic machine in a feedback loop, e.g. implemented in the control system as described herein. Instead of a torque command, a rotational speed command to the hydraulic machine or a rotational acceleration command to the hydraulic machine may alternatively be used. The pressure drop over the hydraulic machine may be a difference between the pressure at the first side and the pressure at the second side. The pressure drop over the hydraulic machine may be calculated either directly, e.g. by means of pressure sensors at the first side and the second side. Alternatively, the pressure drop over the hydraulic machine may be calculated indirectly, e.g. based on the high pressure in the high-pressure side, the low pressure in the low-pressure side and pressure drops over the valve arrangement, and/or based on a difference between reference pressures at the first side and the second side. As a further alternative, for the purpose of calculating the required displacement, the pressure drop over the hydraulic machine can be approximated as the pressure difference between the high pressure in the high-pressure side and the low pressure in the low-pressure side, i.e. by ignoring further pressure drops, such as over the valve arrangement. In other words, in order to calculate the required displacement, a desired or possible maximum pressure drop over the hydraulic machine can be used.

Each of the first speed threshold value, the first power threshold value, and the first torque threshold value may be either constant or variable. For example, the first speed threshold value, the first power threshold value and/or the first torque threshold value may vary depending on a load condition on the hydraulic machine. In case the hydraulic system is used in a working machine, the first speed threshold value, the first power threshold value and/or the first torque threshold value may for example depend on an angle of a slope travelled by the working machine. In case a constant first speed threshold value is used, this may for example be 20-250 rpm/min, such as 50-200 rpm/min.

According to one embodiment, the method further comprises reducing or eliminating the displacement limitation of the hydraulic machine, or maintaining a constant displacement limitation of the hydraulic machine, when the rotational speed of the hydraulic machine is above a second speed threshold value, higher than or equal to the first speed threshold value, when the power of the hydraulic machine is above a second power threshold value, higher than or equal to the first power threshold value, and/or when the torque of the hydraulic machine is above a second torque threshold value, higher than or equal to the first torque threshold value. For example, the displacement limitation may be 10% at rotational speeds below the first speed threshold value, decrease at rotational speeds above the first speed threshold value, and be 2% at rotational speeds above the second speed threshold value. The hydraulic machine is thereby allowed to swash down at higher rotational speeds, at higher powers and/or at higher torques. Thereby, pressure losses over the valve arrangement are reduced at high speed/high power/high torque operations.

Each of the second speed threshold value, the second power threshold value and the second torque threshold value may be constant. According to one example, the first speed threshold value is 200 rpm and the second speed threshold value is 500 rpm. Alternatively, each of the second speed threshold value, the second power threshold value and the second torque threshold value may be variable. For example, the second speed threshold value, the second power threshold value and/or the second torque threshold value may vary depending on a load condition on the hydraulic machine. However, the second speed threshold value is always equal to or larger than the first speed threshold value, the second power threshold value is always equal to or larger than the first power threshold value and the second torque threshold value is always equal to or larger than the first torque threshold value.

According to one embodiment, the method further comprises gradually reducing the displacement limitation of the hydraulic machine when the rotational speed of the hydraulic machine increases from the first speed threshold value, when the power of the hydraulic machine increases from the first power threshold value, and/or when the torque of the hydraulic machine increases from the first torque threshold value. The displacement limitation may gradually reduce to zero. Alternatively, the displacement may gradually reduce until the second speed threshold value, the second power threshold value and/or the second torque threshold value is reached.

According to one embodiment, the method further comprises determining the pressure drop over the hydraulic machine based on a pressure difference between the high-pressure side and the low-pressure side. The pressure drop over the hydraulic machine may for example be determined as the pressure difference between the high-pressure side and the low-pressure side minus the pressure drops over the valve arrangement. The pressure drops over the valve arrangement may be measured, calculated or estimated.

According to one embodiment, a pressure difference between the first side and the second side is smaller in the valve control mode than in the displacement control mode, at least during steady state operation of the hydraulic system. This is a consequence of controlling the valve arrangement to a larger extent, e.g. with a higher pressure drop over the valve arrangement, in the valve control mode than in the displacement control mode. In other words, a pressure difference between the first side and the second side is smaller when controlling the rotatable load by controlling the valve arrangement than when controlling the rotatable load mainly by controlling the displacement of the hydraulic machine. Thus, the total pressure drop over the valve arrangement, e.g. from the high-pressure side and to the low-pressure side, is larger in the valve control mode than in the displacement control mode. However, for short time periods of non-steady state operation of the hydraulic system, for example during short periods of deceleration, the pressure difference between the first side and the second side may be larger in the valve control mode than in the displacement control mode.

According to one embodiment, the method further comprises switching a fluid communication between the high-pressure side and the first side to a fluid communication between the high-pressure side and the second side by means of the valve arrangement. Thereby, the pressurized side of the hydraulic machine can be switched by means of the valve arrangement. For example, when driving the hydraulic machine as a motor and supplying fluid from the high-pressure side to the first side and from the second side to the low-pressure side by means of the valve arrangement, a braking action of the hydraulic machine can be initiated by switching the high-pressure side to the second side and switching the first side to the low-pressure side. The hydraulic machine will then start to operate as a pump that pumps hydraulic fluid to the high-pressure side to recuperate energy as the rotatable load decelerates. This switching can be made both in the valve control mode and in the displacement control mode.

According to one embodiment, the rotatable load is entirely controlled by controlling the displacement of the hydraulic machine in the displacement control mode. For example, the rotatable load may be entirely controlled by controlling the displacement of the hydraulic machine, if the required displacement is larger than the displacement limitation of the hydraulic machine. That is, each valve of the valve arrangement may be kept still, preferably in a maximum open position, in the displacement control mode to reduce pressure losses over the valve arrangement.

According to one embodiment, the method further comprises controlling the displacement of the hydraulic machine by means of closed loop control in the displacement control mode. For example, a closed loop control of the hydraulic machine may be used when the required displacement is larger than the displacement limitation of the hydraulic machine.

According to one embodiment, the control of the rotatable load comprises controlling one of torque, rotational position, rotational speed, and rotational acceleration of the rotatable load. For example, in order to control the torque of the rotatable load, the pressure drop over the hydraulic machine and/or the displacement may be controlled.

According to one embodiment, the hydraulic machine is a two-quadrant hydraulic machine operative as a pump and as a motor. Such hydraulic machine may alternatively be referred to as a positive displacement hydraulic machine or an irreversible two-quadrant hydraulic machine, for example having a displacement of 0% to 100%. An over-center hydraulic machine in contrast is reversible, for example having a displacement of −100% to 100%. The displacement of an irreversible hydraulic machine cannot pass the zero position while the displacement of a reversible hydraulic machine can pass the zero position.

According to a second aspect, the object is achieved by a hydraulic system for controlling a rotatable load. The hydraulic system comprising a high-pressure side; a low-pressure side; a variable displacement hydraulic machine for rotationally driving the rotatable load; and a valve arrangement in fluid communication with the high-pressure side, the low-pressure side, a first side of the hydraulic machine and a second side of the hydraulic machine. The hydraulic system further comprises a control system configured to determine if the hydraulic system is in a first operating state or a second operating state, the determination being based at least on one of a commanded or actual rotational speed of the hydraulic machine, a commanded or actual torque of the hydraulic machine, and/or a commanded or actual power of the hydraulic machine; control the rotatable load in a valve control mode if the hydraulic system is in the first operating state, the valve control mode comprising controlling the rotatable load by controlling the valve arrangement; control the rotatable load in a displacement control mode if the hydraulic system is in the second operating state, the displacement control mode comprising controlling the rotatable load mainly by controlling the displacement of the hydraulic machine; and applying a non-zero absolute minimum displacement limitation to the hydraulic machine at least in the valve control mode.

Since the hydraulic system comprises a high-pressure side and a low-pressure side, the hydraulic system forms a dual pressure system. The hydraulic system may be a common pressure rail hydraulic system.

According to one embodiment, the displacement limitation in the valve control mode and/or a displacement of the hydraulic machine in the valve control mode, is at least 60%, such as at least 80%, such as 100%.

According to one embodiment, the control system is configured to apply the displacement limitation to the hydraulic machine at least when a rotational speed of the hydraulic machine is below a first speed threshold value, when a power of the hydraulic machine is below a first power threshold value and/or when a torque of the hydraulic machine is below a first torque threshold value; determine a required displacement of the hydraulic machine based on a command for the hydraulic machine and a pressure drop over the hydraulic machine; and determine that the hydraulic system is in the first operating state, if the required displacement is smaller than the displacement limitation of the hydraulic machine; and determine that the hydraulic system is in the second operating state, if the required displacement is larger than the displacement limitation of the hydraulic machine.

The control system according to this embodiment may alternatively be defined as configured to apply configured to apply a non-zero absolute minimum displacement limitation to the hydraulic machine at least when a rotational speed of the hydraulic machine is below a first speed threshold value, when a power of the hydraulic machine is below a first power threshold value and/or when a torque of the hydraulic machine is below a first torque threshold value; determine a required displacement of the hydraulic machine based on a command for the hydraulic machine and a pressure drop over the hydraulic machine; control the rotatable load by controlling the valve arrangement, if the required displacement is smaller than the displacement limitation of the hydraulic machine; and control the rotatable load mainly by controlling the displacement of the hydraulic machine, if the required displacement is larger than the displacement limitation of the hydraulic machine.

According to one embodiment, the control system is configured to reduce or eliminate the displacement limitation of the hydraulic machine, or maintain a constant displacement limitation of the hydraulic machine, when the rotational speed of the hydraulic machine is above a second speed threshold value, higher than or equal to the first speed threshold value, when the power of the hydraulic machine is above a second power threshold value, higher than or equal to the first power threshold value, and/or when the torque of the hydraulic machine is above a second torque threshold value, higher than or equal to the first torque threshold value.

According to one embodiment, the control system is configured to gradually reduce the displacement limitation of the hydraulic machine when the rotational speed of the hydraulic machine increases from the first speed threshold value, when the power of the hydraulic machine increases from the first power threshold value, and/or when the torque of the hydraulic machine increases from the first torque threshold value.

According to one embodiment, the control system is configured to determine the pressure drop over the hydraulic machine based on a pressure difference between the high-pressure side and the low-pressure side.

According to one embodiment, the control system is configured to control the valve arrangement to switch a fluid communication between the high-pressure side and the first side to a fluid communication between the high-pressure side and the second side.

According to one embodiment, the control system is configured to control the rotatable load entirely by controlling the displacement of the hydraulic machine in the displacement control mode. For example, the control system may be configured to control the rotatable load entirely by controlling the displacement of the hydraulic machine, if the required displacement is larger than the displacement limitation of the hydraulic machine.

According to one embodiment, the control system is configured to control the displacement of the hydraulic machine by means of closed loop control in the displacement control mode. For example, the control system may be configured to control the displacement of the hydraulic machine by means of closed loop control when the required displacement is larger than the displacement limitation of the hydraulic machine.

According to one embodiment, the control of the rotatable load comprises controlling one of torque, rotational position, rotational speed, and rotational acceleration of the rotatable load.

According to one embodiment, the valve arrangement comprises at least one valve having at least two variable positions establishing at least two different opening areas. By varying the opening area, the at least one valve can control the flow therethrough. The pressure drop is higher through a smaller opening area than through a larger opening area.

According to one embodiment, the hydraulic machine is a two-quadrant hydraulic machine operative as a pump and as a motor. Since the first side can be connected to the high-pressure side and the second side can be connected to the low-pressure side, and vice versa, by means of the valve arrangement, the hydraulic system provides the same functions as a four-quadrant hydraulic machine, while only requiring a cheaper two-quadrant hydraulic machine.

According to one embodiment, the pressure on the high-pressure side varies above 50 bars, and the pressure on the low-pressure side varies below 50 bars, during operation of the hydraulic system. For example, the pressure on the high-pressure side may vary between 51-500 bars, such as between 200-350 bars, and the pressure on the low-pressure side may vary between 1-50 bars, such as between 15-30 bars, during operation of the hydraulic system. Thus, the high pressure may be kept within a high pressure interval and the low pressure may be kept within a low pressure interval, with no overlap between the high pressure interval and the low pressure interval.

According to one embodiment, the hydraulic system further comprises a main pump arranged to pressurize the high-pressure side. The main pump may comprise one port connected to the high-pressure side and one port connected to the low-pressure side.

According to one embodiment, the hydraulic system further comprises at least one high-pressure hydraulic energy storage connected to the high-pressure side and/or at least one low-pressure hydraulic energy storage connected to the low-pressure side. The high-pressure hydraulic energy storage and/or the low-pressure hydraulic energy storage may comprise a hydraulic accumulator.

The invention also relates to a working machine comprising a hydraulic system according to the invention.

Further advantages and advantageous features of the invention are disclosed in the following description and in the dependent claims.

BRIEF DESCRIPTION OF THE DRAWINGS

With reference to the appended drawings, below follows a more detailed description of embodiments of the invention cited as examples.

In the drawings.

DETAILED DESCRIPTION OF EXAMPLE EMBODIMENTS OF THE INVENTION

Figure 1:
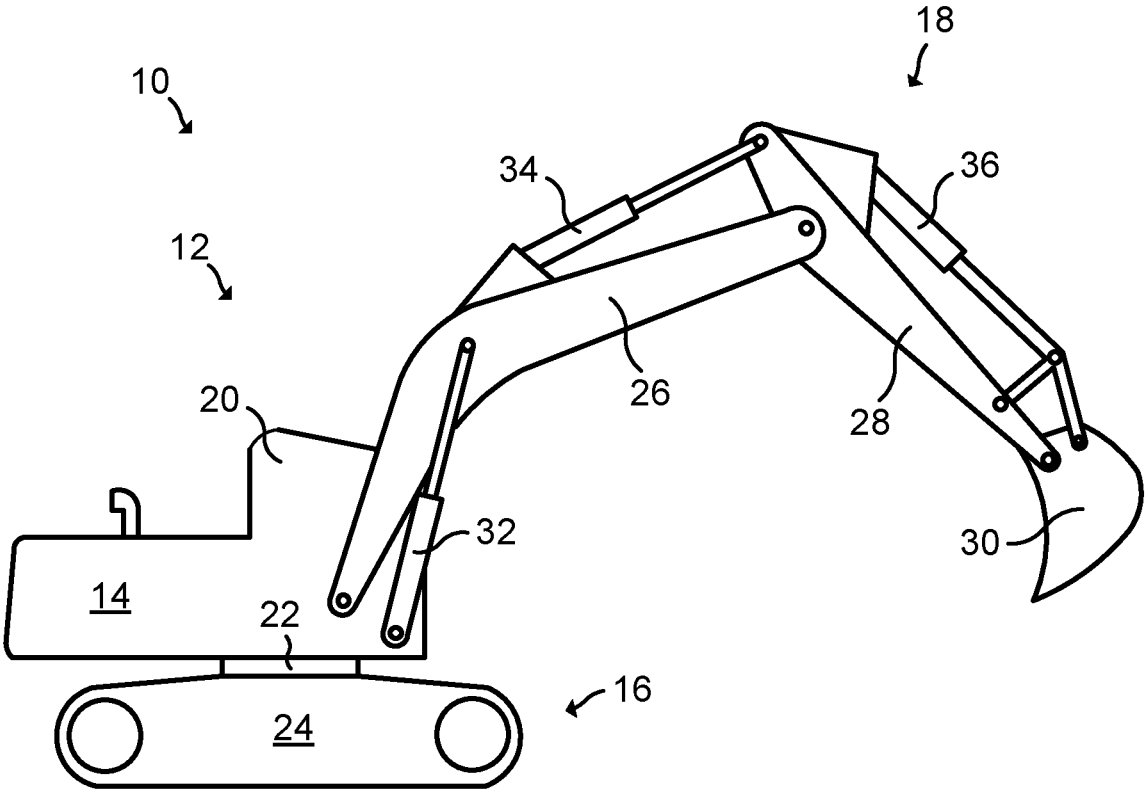
FIG. 1 is a schematic illustration of a working machine according to the invention comprising a hydraulic system according to the invention.

In the following, a method of controlling a rotatable load by a hydraulic system, a hydraulic system for controlling a rotatable load, and a working machine, will be described. The same reference numerals will be used to denote the same or similar structural features.

FIG. 1 is a schematic illustration of a working machine 10 according to the invention. The working machine 10 comprises a hydraulic system 12 according to the invention. In FIG. 1, the working machine 10 is exemplified as an excavator.

The working machine 10 comprises an upper swing structure 14, a lower travel structure 16 and a working device 18. The working machine 10 further comprises a cab 20 in the upper swing structure 14, and a rotatable load 22 in the form of a swing motor between the upper swing structure 14 and the lower travel structure 16. The lower travel structure 16 comprises two rotatable loads 24 in the form of travel motors (only one is visible in FIG. 1) for driving a respective crawler track.

The working device 18 comprises a boom 26, an arm 28 and a bucket 30. The working device 18 further comprises two boom cylinders 32 (only one is visible in FIG. 1), an arm cylinder 34 and a bucket cylinder 36. The boom cylinders 32 operate between the upper swing structure 14 and the boom 26. The arm cylinder 34 operates between the boom 26 and the arm 28. The bucket cylinder 36 operates between the arm 28 and the bucket 30.

Figure 2:
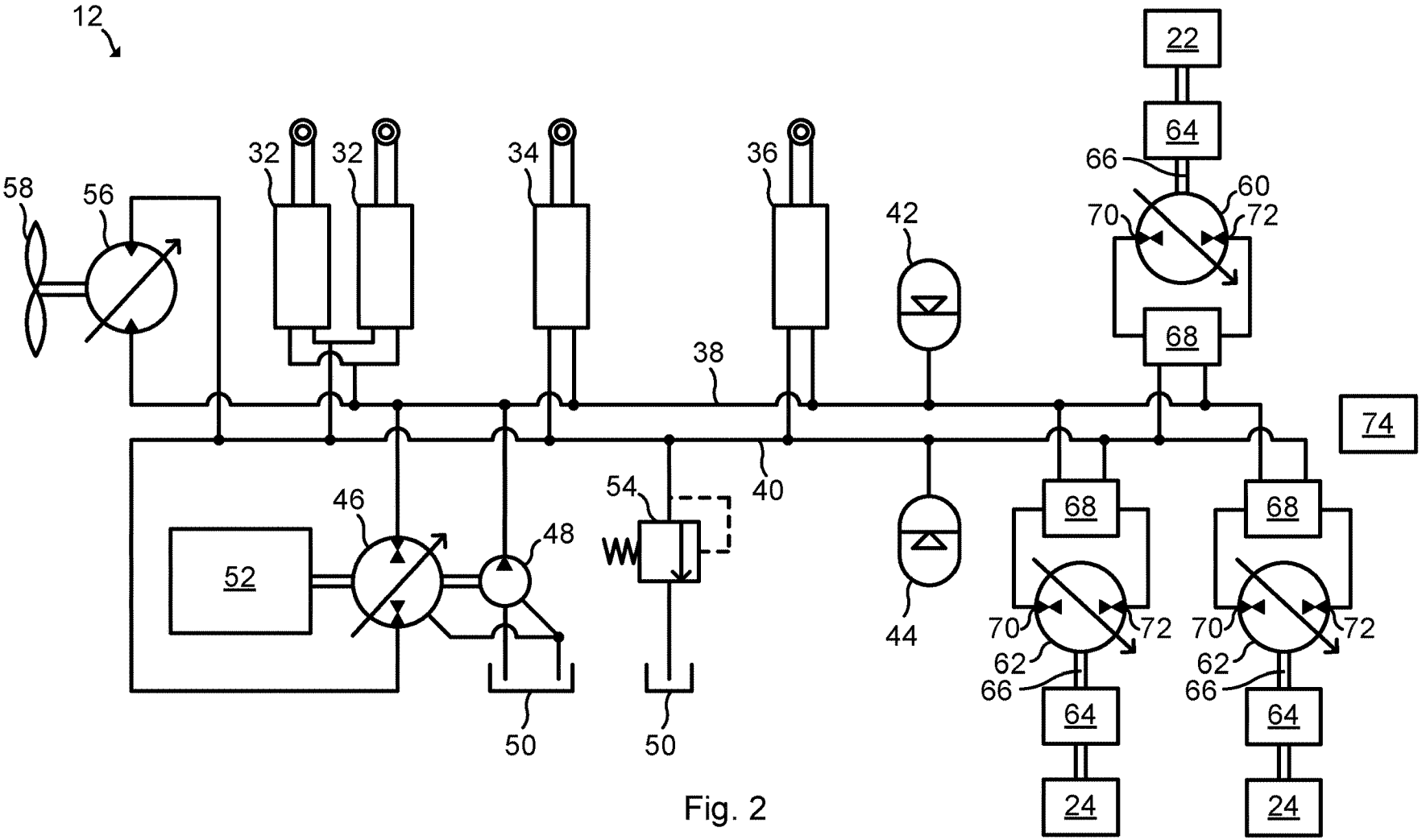
FIG. 2 is a block diagram of the hydraulic system.

FIG. 2 is a block diagram of the hydraulic system 12 in FIG. 1 according to an embodiment of the invention. The hydraulic system 12 comprises a high-pressure side 38 and a low-pressure side 40.

In the example in FIG. 2, the high-pressure side 38 and the low-pressure side 40 are arranged in a common pressure rail (CPR) architecture. The high-pressure side 38 comprises a high-pressure rail and the low-pressure side 40 comprises a low-pressure rail. The high-pressure side 38 and the low-pressure side 40 may alternatively be referred to as a high-pressure circuit and a low-pressure circuit, respectively. The high-pressure side 38 and the low-pressure side 40 form a dual pressure system comprising two charging circuits at different pressure levels (the high-pressure side 38 and the low-pressure side 40). The hydraulic system 12 thus comprises a dedicated high-pressure side 38 and a dedicated low-pressure side 40. The dual pressure hydraulic system 12 differs from load sensing hydraulic systems where pressure is to a substantially larger extent adjusted depending on load, i.e. a resistive control.

During operation of the hydraulic system 12, the pressure in the high-pressure side 38 is higher than the pressure in the low-pressure side 40. These pressure levels may vary somewhat during operation of the hydraulic system 12 while the pressure in the high-pressure side 38 is higher than the pressure in the low-pressure side 40. The high pressure in the high-pressure side 38 may for example be 200-350 bars±10%, such as 250 bars±10%, during operation of the hydraulic system 12. The low pressure in the low-pressure side 40 may for example be 15-30 bars±10% during operation of the hydraulic system 12. The high pressure in the high-pressure side 38 may for example be 330 bars when the boom 26 is in a low position and 200 bars when the boom 26 is in a high position.

The hydraulic system 12 further comprises a high-pressure hydraulic energy storage 42 and a low-pressure hydraulic energy storage 44. The high-pressure hydraulic energy storage 42 is connected to the high-pressure side 38 and the low-pressure hydraulic energy storage 44 is connected to the low-pressure side 40. In FIG. 2, each of the high-pressure hydraulic energy storage 42 and the low-pressure hydraulic energy storage 44 is exemplified as an accumulator. The high-pressure hydraulic energy storage 42 can store/release hydraulic energy from/to the high-pressure side 38. The low-pressure hydraulic energy storage 44 can store/release hydraulic energy from/to the low-pressure side 40. The high-pressure hydraulic energy storage 42 requires a higher energy storage capacity in case the pressure variation in the high-pressure side 38 is low and vice versa. The same applies for the low-pressure hydraulic energy storage 44 with respect to the low-pressure side 40.

The hydraulic system 12 further comprises a main pump 46. In FIG. 2, the main pump 46 is connected to the high-pressure side 38 and the low-pressure side 40. The main pump 46 is arranged to pressurize the high-pressure side 38. The main pump 46 is here exemplified as a variable displacement hydraulic machine operative as both pump and motor.

The hydraulic system 12 further comprises an auxiliary pump 48. In the example in FIG. 2, the auxiliary pump 48 is arranged to supply pressurized fluid from a tank 50 to the high-pressure side 38. The auxiliary pump 48 of this example is a fixed displacement pump. The main pump 46 and the auxiliary pump 48 are connected to a common drive shaft driven by an internal combustion engine 52 of the working machine 10.

The hydraulic system 12 of this example further comprises a pressure relief valve 54 connected between the low-pressure side 40 and the tank 50. The hydraulic system 12 further comprises a fan motor 56, and a fan 58 arranged to be driven by the fan motor 56.

The hydraulic system 12 further comprises three variable displacement hydraulic machines 60, 62. The hydraulic machine 60 is arranged to rotationally drive the rotatable load 22 and each of the two hydraulic machines 62 is arranged to rotationally drive a respective rotatable load 24. In this example, each hydraulic machine 60, 62 is a two-quadrant hydraulic machine operative as a pump and a motor, i.e. an irreversible variable displacement hydraulic machine. Each hydraulic machine 60, 62 has a displacement variable between 0% and 100%. The hydraulic system 12 needs to be able to control the speed of each hydraulic machine 60, 62 while the pressure in the high-pressure side 38 is kept within a high pressure interval.

The hydraulic system 12 further comprises three gearboxes 64. Each gearbox 64 is arranged between a hydraulic machine 60, 62 and a rotatable load 22, 24, and is driven by a drive shaft 66 of a respective hydraulic machine 60, 62.

The hydraulic system 12 further comprises three valve arrangements 68. Each valve arrangement 68 is associated with one of the rotatable loads 22, 24. Each valve arrangement 68 is in fluid communication with the high-pressure side 38, the low-pressure side 40, a first port or first side 70 of an associated hydraulic machine 60, 62 and a second port or second side 72 of an associated hydraulic machine 60, 62.

Furthermore, each valve arrangement 68 is configured to selectively establish a fluid communication between the high-pressure side 38 and the first side 70, selectively establish a fluid communication between the high-pressure side 38 and the second side 72, selectively establish a fluid communication between the low-pressure side 40 and the first side 70, and selectively establish a fluid communication between the low-pressure side 40 and the second side 72. Thus, each valve arrangement 68 is configured to switch a fluid communication between the high-pressure side 38 and the first side 70 to a fluid communication between the high-pressure side 38 and the second side 72.

The hydraulic system 12 further comprises a control system 74. The control system 74 comprises a data processing device and a memory having a computer program stored thereon, the computer program comprising program code which, when executed by the data processing device causes the data processing device to perform various steps, or command execution of various steps, as described herein.

Figure 3:
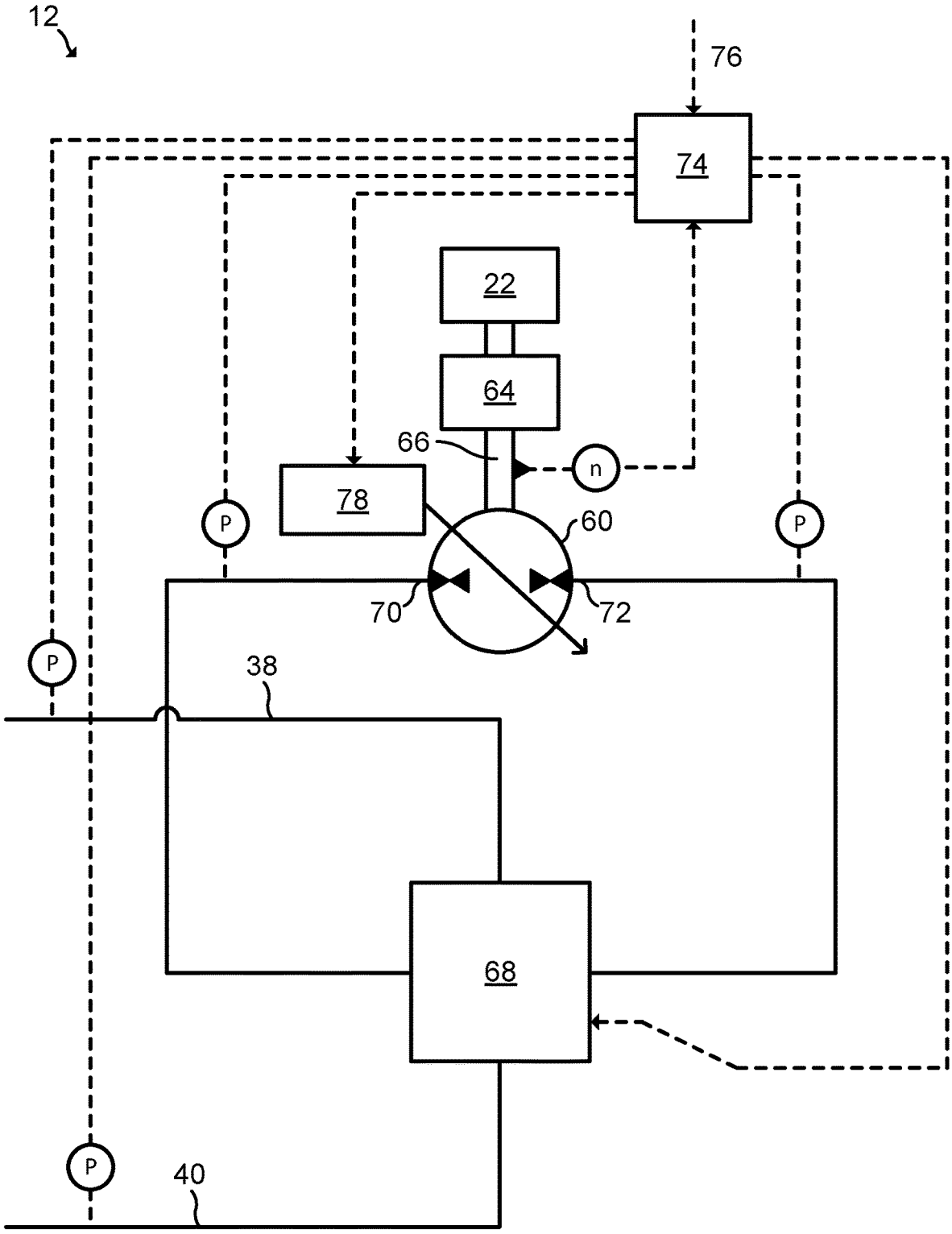
FIG. 3 is a partial enlarged view of the hydraulic system in FIG. 2.

FIG. 3 is a partial enlarged view of the hydraulic system 12 in FIG. 2. In connection with FIG. 3, a method of controlling the rotatable load 22 by the hydraulic system 12 will be described. Each of the rotatable loads 24 can also be controlled in the same way.

As illustrated in FIG. 3, the control system 74 is arranged to receive a reference signal or command 76 for the hydraulic machine 60, a signal indicative of a rotational speed of the hydraulic machine 60, and signals indicative of the pressures in the high-pressure side 38, the low-pressure side 40, the first side 70 and the second side 72. The control system 74 is further configured to control the valve arrangement 68, and to control the displacement of the hydraulic machine 60 by means of a displacement controller 78.

The method of this example comprises applying a non-zero absolute minimum displacement limitation to the hydraulic machine 60 when the rotational speed of the hydraulic machine 60 is below a first speed threshold value. Since the hydraulic machine 60 has a displacement variable between 0% and 100%, a non-zero absolute minimum displacement limitation of for example 10% is applied. When the displacement limitation is applied to the hydraulic machine 60, the displacement can thus vary between 10% and 100%.

In this example, the displacement limitation is applied by means of software in the control system 74. To this end, it is determined whether a rotational speed of the hydraulic machine 60 is below the first speed threshold value. The first speed threshold value may be either constant, for example 200 rpm, or variable. A variable first speed threshold value may depend on operating conditions of the working machine 10. However, a hardware displacement limitation on the hydraulic machine 60 may alternatively be employed.

The displacement limitation may or may not also be applied at rotational speeds above the first speed threshold value. Naturally, a hardware displacement limitation on the hydraulic machine 60 will be present at all rotational speeds. In case a software limitation is employed, the displacement limitation may be reduced, eliminated or maintained constant above a second speed threshold value, higher than or equal to the first speed threshold value. Between the first speed threshold value and the second speed threshold value, the displacement limitation may be gradually reduced. Also the second speed threshold value may be either constant, for example 500 rpm, or variable. Also a variable second speed threshold value may depend on operating conditions of the working machine 10. Various types of control of the displacement limitation is possible as long as a displacement limitation, by means of hardware or software, is applied to the hydraulic machine 60 at low power operations, low torque operations and/or low speed operations, e.g. at rotational speeds below the first speed threshold value.

The method of this example further comprises determining a required displacement of the hydraulic machine 60 based on the command 76 for the hydraulic machine 60 and a pressure drop over the hydraulic machine 60. The command 76 may for example be a torque command in a feedback loop of the control system 74. Alternatively, the command 76 may be a rotational speed command or a rotational acceleration command to the hydraulic machine 60. In the example in FIG. 3, pressure sensors are provided for sensing the pressures at the first side 70 and the second side 72 of the hydraulic machine 60. Thereby, the pressure drop over the hydraulic machine 60 can be directly calculated based on these pressures. However, the pressure drop over the hydraulic machine 60 can be calculated or determined in alternative ways. For example, the pressure drop over the hydraulic machine 60 can be estimated based on target pressures at the first side 70 and the second side 72. These target pressures may in turn be calculated based on the high pressure in the high-pressure side 38, the low pressure in the low-pressure side 40, and valve openings of one or more valves in the valve arrangement 68. As a further example, the required displacement can be calculated by approximating the pressure drop over the hydraulic machine 60 as the difference between the high pressure in the high-pressure side 38 and the low pressure in the low-pressure side 40. Thus, a desired or possible maximum pressure drop over the hydraulic machine 60 may be used when calculating the required displacement.

The method of this example further comprises comparing the required displacement with the displacement limitation of the hydraulic machine 60. If the required displacement is smaller than the displacement limitation, e.g. lower than 10%, it is determined that the hydraulic system 12 is in a first operating state. In the first operating state, the rotatable load 22 is controlled by controlling the valve arrangement 68, i.e. by means of a valve control mode as described herein. If the required displacement is larger than the displacement limitation, e.g. higher than 10%, it is determined that the hydraulic system 12 is in a second operating state. In the second operating state, the rotatable load 22 is controlled by mainly controlling the displacement of the hydraulic machine 60, i.e. by means of a displacement control mode as described herein.

The control system 74 is configured to continuously or repeatedly determine a required displacement of the hydraulic machine 60 and to continuously or repeatedly compare the required displacement with the current minimum displacement limitation. The control of the hydraulic machine 60 will thus switch between the valve control mode and the displacement control mode during various operation cycles of the working machine 10.

In the valve control mode, a control of the flow through the valve arrangement 68 is involved to control the rotatable load 22. However, a control of the displacement of the hydraulic machine 60 may also be involved to control the rotatable load 22 in the valve control mode. In the valve control mode, the pressure drop over the hydraulic machine 60 may be less than 50% of the pressure difference between the high-pressure side 38 and the low-pressure side 40. Thus, a major part of the pressure drop will occur over the valve arrangement 68 in the valve control mode.

In the displacement control mode, the rotatable load 22 is mainly controlled by controlling the displacement of the hydraulic machine 60. For example, in case the pressure drop over the hydraulic machine 60 constitutes at least 80% of the pressure difference between the high-pressure side 38 and the low-pressure side 40, the rotatable load 22 may be said to be mainly controlled by controlling the displacement of the hydraulic machine 60. According to one example, the rotatable load 22 is entirely controlled by controlling the displacement of the hydraulic machine 60 in the displacement control mode, e.g. an opening area of each valve of the valve arrangement 68 is kept stationary, preferably as large as possible to reduce pressure drop over the valve arrangement 68. However, a control of the flow through the valve arrangement 68 may optionally also be involved to control the rotatable load 22 in the displacement control mode. In any case, a pressure difference between the pressure at the first side 70 and the pressure at the second side 72 is higher in the displacement control mode than in the valve control mode, at least at most times, e.g. except for short times after switching a fluid communication between the high-pressure side 38 and the first side 70 to a fluid communication between the high-pressure side 38 and the second side 72.

Figure 4:
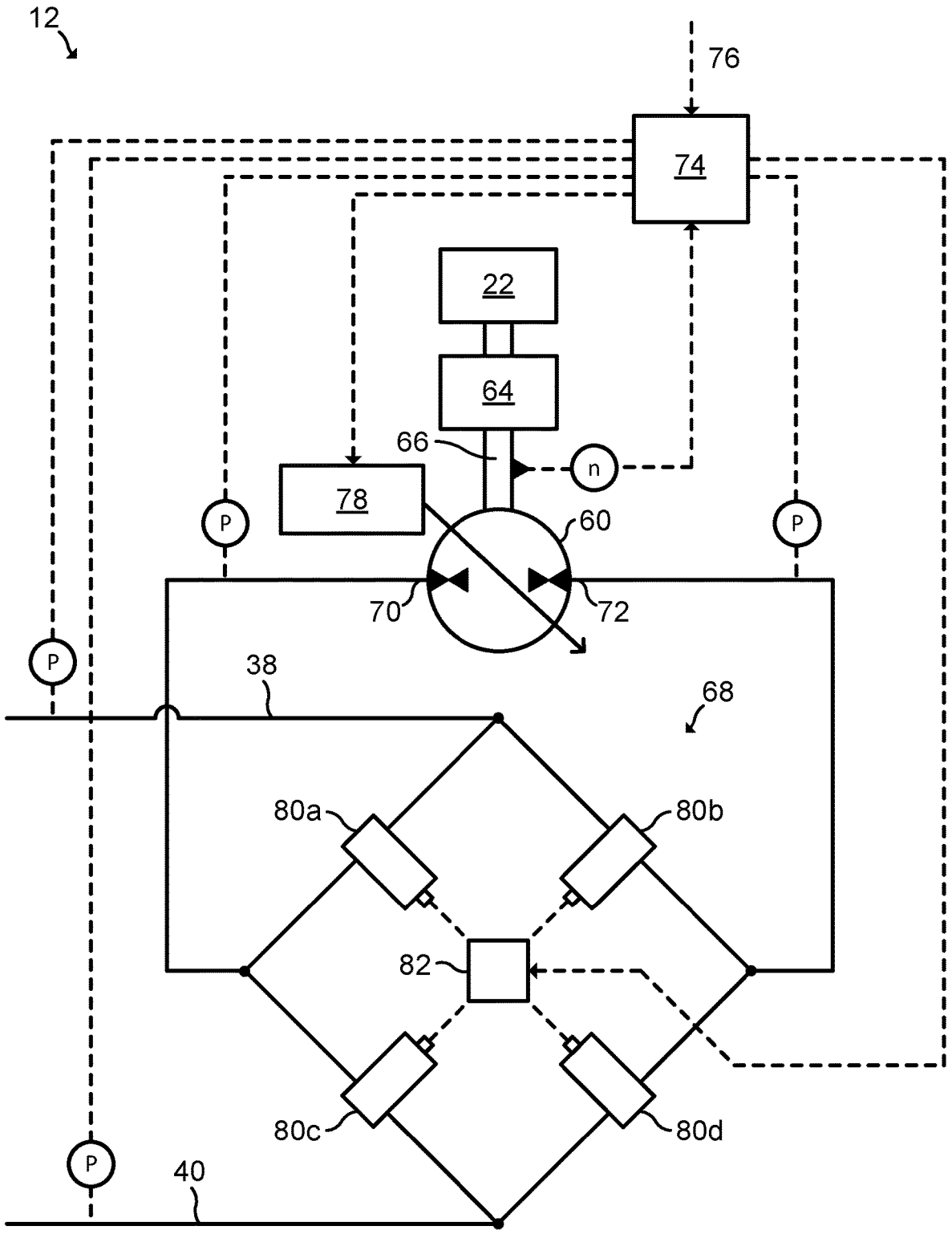
FIG. 4 is a partial enlarged view of the hydraulic system in FIG. 2 showing one example of a valve arrangement.

FIG. 4 is a partial enlarged view of the hydraulic system 12 in FIG. 2 showing one example of a valve arrangement 68. The valve arrangement 68 of this example comprises four electro-hydraulic proportional valves 80*a*-80*d*. Each valve 80*a*-80*d* comprises a plurality of different positions establishing a plurality of different opening areas. The first valve 80*a* is arranged between the high-pressure side 38 and the first side 70. The second valve 80*b* is arranged between the high-pressure side 38 and the second side 72. The third valve 80*c* is arranged between the low-pressure side 40 and the first side 70. The fourth valve 80*d* is arranged between the low-pressure side 40 and the second side 72. The valve arrangement 68 of the example in FIG. 4 further comprises a PWM (Pulse Width Modulation) controller 82 for controlling the valves 80*a*-80*d* based on commands from the control system 74.

In the valve control mode, the second valve 80*b* and the third valve 80*c* may be closed, and the opening area of the first valve 80*a* and the opening area of the fourth valve 80*d* may be controlled in order to control rotation of the rotatable load 22 in a first direction. In this case, a pressure difference between the high-pressure side 38 and the low-pressure side 40, minus the pressure drop over the first valve 80*a*, minus the pressure drop over the fourth valve 80*d*, may constitute the pressure drop over the hydraulic machine 60.

Furthermore, in the valve control mode, the first valve 80*a* and the fourth valve 80*d* may be closed, and the opening area of the second valve 80*b* and the opening area of the third valve 80*c* may be controlled in order to control rotation of the rotatable load 22 in a second direction, opposite to the first direction. In this case, a pressure difference between the high-pressure side 38 and the low-pressure side 40, minus the pressure drop over the second valve 80*b*, minus the pressure drop over the third valve 80*c*, may constitute the pressure drop over the hydraulic machine 60.

In the displacement control mode, the second valve 80*b* and the third valve 80*c* may be closed, and the opening area of the first valve 80*a* and the opening area of the fourth valve 80*d* may be set and maintained as large as possible while rotation of the rotatable load 22 in the first direction is controlled by controlling the displacement of the hydraulic machine 60. Thereby, a maximum pressure drop over the hydraulic machine 60 is provided. Furthermore, in the displacement control mode, the first valve 80*a* and the fourth valve 80*d* may be closed, and the opening area of the second valve 80*b* and the opening area of the third valve 80*c* may be set and maintained as large as possible while rotation of the rotatable load 22 in the second direction is controlled by controlling the displacement of the hydraulic machine 60.

Figure 5:
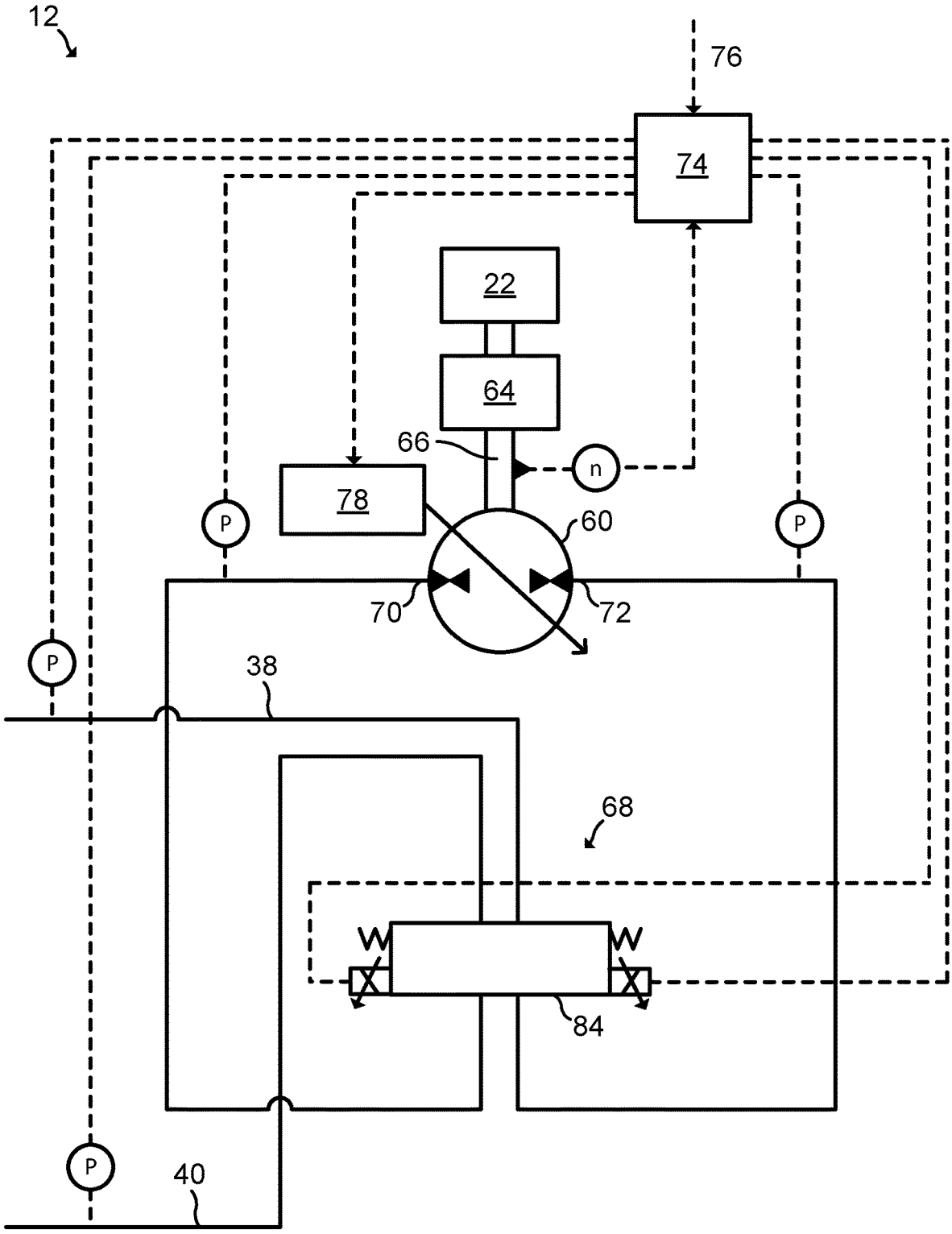
FIG. 5 is a partial enlarged view of the hydraulic system in FIG. 2 showing a further example of a valve arrangement.

FIG. 5 is a partial enlarged view of the hydraulic system 12 in FIG. 2 showing a further example of the valve arrangement 68. The valve arrangement 68 comprises a valve 84. The valve 84 of this example is a 4/3 spool valve. Similar to the valve arrangement 68 in FIG. 4, also the valve arrangement 68 in FIG. 5 is configured to establish a fluid communication between the high-pressure side 38 and the first side 70 to rotationally drive the rotatable load 22 in the first direction, and to establish a fluid communication between the high-pressure side 38 and the second side 72 to rotationally drive the rotatable load 22 in the second direction.

Figure 6:
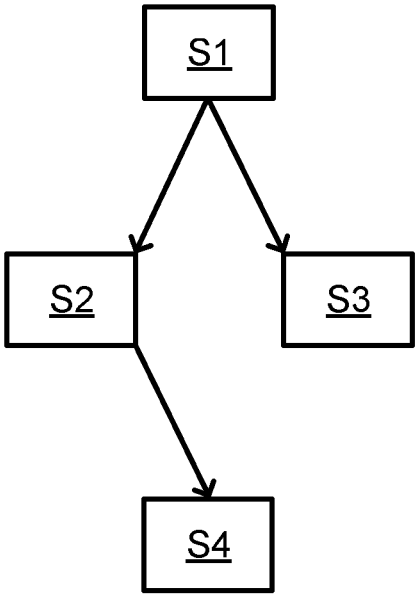
FIG. 6 is a flowchart outlining the general steps of the method according to the invention.

FIG. 6 is a flowchart outlining the general steps of the method according to the invention. The method comprises determining 51 if the hydraulic system 12 is in a first operating state or a second operating state, the determination being based at least on one of a commanded or actual rotational speed 88 of the hydraulic machine 60, 62, a commanded or actual torque of the hydraulic machine 60, 62, and/or a commanded or actual power of the hydraulic machine 60, 62; controlling S2 the rotatable load 22, 24 in a valve control mode if the hydraulic system 12 is in the first operating state, the valve control mode comprising controlling the rotatable load 22, 24 by controlling the valve arrangement 68; controlling S3 the rotatable load 22, 24 in a displacement control mode if the hydraulic system 12 is in the second operating state, the displacement control mode comprising controlling the rotatable load 22, 24 mainly by controlling the displacement 90 of the hydraulic machine 60, 62; and applying S4 a non-zero absolute minimum displacement limitation 86 to the hydraulic machine 60, 62 at least in the first operating state.

Figure 7:
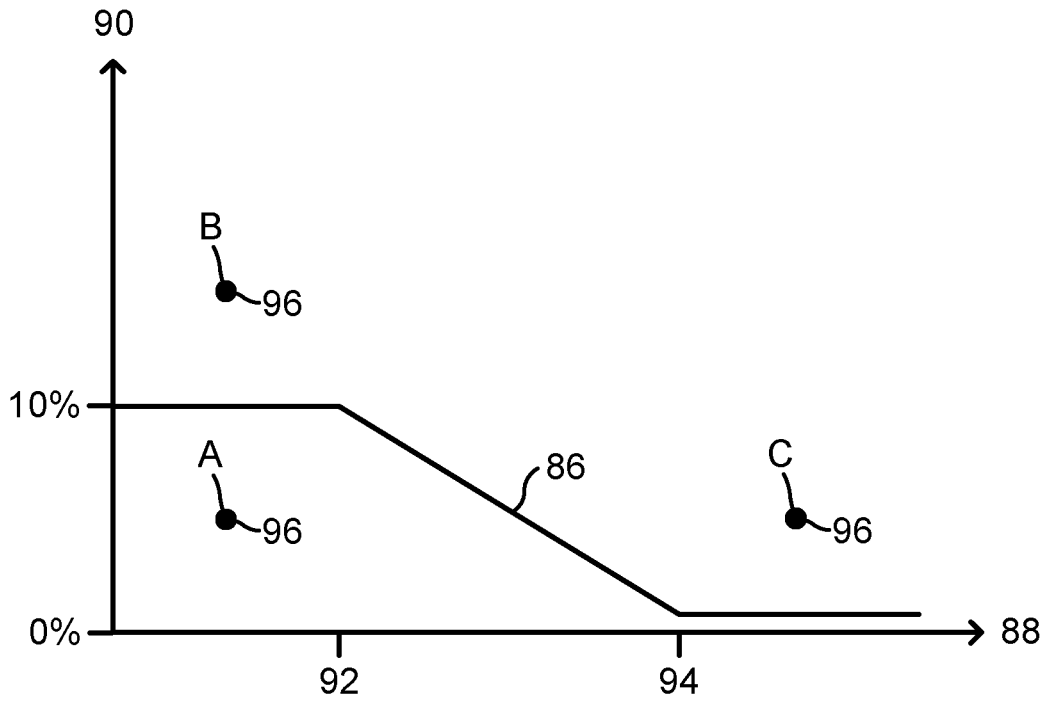
FIG. 7 is a diagram showing one example of a displacement limitation as a function of rotational speed of a hydraulic machine.

FIG. 7 is a diagram showing one illustrative example of the displacement limitation 86 as a function of the rotational speed 88 of the hydraulic machine 60. The rotational speed 88 may for example be a measured rotational speed 88. In the diagram, the abscissa shows the rotational speed 88 and the ordinate shows the displacement 90. In the example in FIG. 7, the first speed threshold value 92 is set to 200 rpm and the second speed threshold value 94 is set to 500 rpm. At rotational speeds 88 below the first speed threshold value 92, the displacement limitation 86 is set to 10%. At rotational speeds 88 above the second speed threshold value 94, the displacement limitation 86 is set to 2%.

The displacement limitation 86 linearly decreases from 10% to 2% as the rotational speed 88 increases from the first speed threshold value 92 to the second speed threshold value 94.

FIG. 7 further shows three examples of determined required displacements 96 for the hydraulic machine 60. In operation point A at a rotational speed 88 of 100 rpm, the required displacement 96 is 5%, i.e. smaller than the displacement limitation 86 of 10% at a rotational speed 88 of 100 rpm. Thereby, in operation point A, it is determined that the hydraulic system 12 is in the first operating state and the valve control mode of the hydraulic machine 60 is consequently selected.

In operation point B at a rotational speed 88 of 100 rpm, the required displacement 96 is 15%, i.e. larger than the displacement limitation 86 of 10% at a rotational speed 88 of 100 rpm. Thereby, in operation point B, it is determined that the hydraulic system 12 is in the second operating state and the displacement control mode of the hydraulic machine 60 is consequently selected.

In operation point C at a rotational speed 88 of 600 rpm, the required displacement 96 is 5%, i.e. larger than the displacement limitation 86 of 2% at a rotational speed 88 of 600 rpm. Thereby, in operation point C, it is determined that the hydraulic system 12 is in the second operating state and the displacement control mode of the hydraulic machine 60 is selected.

Figure 8:
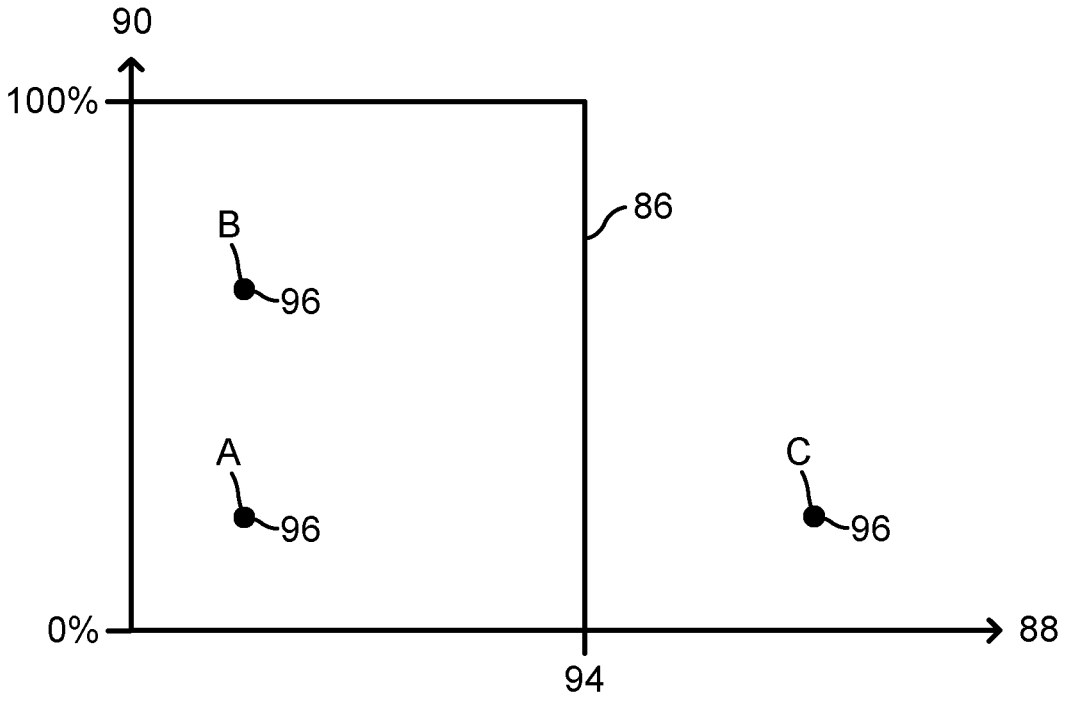
FIG. 8 is a diagram showing a further illustrative example of a displacement limitation as a function of rotational speed of the hydraulic machine.

FIG. 8 is a diagram showing a further illustrative example of the displacement limitation 86 as a function of rotational speed 88 of the hydraulic machine 60 according to an alternative embodiment. Mainly differences will be described. In FIG. 8, a speed threshold value 94 is used as a basis for determining whether the hydraulic system 12 is in the first operating state or the second operating state. The speed threshold value 94 may be constituted by a second speed threshold value according to the present disclosure. In this case, the first speed threshold value and the second speed threshold value may for example adopt the same value. When the rotational speed 88 is lower than the speed threshold value 94, it is determined that the hydraulic system 12 is in the first operating state and the valve control mode is consequently adopted by the hydraulic system 12. When the rotational speed 88 is higher than the speed threshold value 94, it is determined that the hydraulic system 12 is in the second operating state and the displacement control mode is consequently adopted by the hydraulic system 12. Thus, in this embodiment, it is not necessary to determine a required displacement of the hydraulic machine 60 in order to decide whether the hydraulic system operates in the first operating state or the second operating state.

Furthermore, in the example in FIG. 8, a displacement limitation 86 of 100% is set in the valve control mode, i.e. at rotational speeds below the speed threshold value 94. In the displacement control mode, i.e. above the speed threshold value 94, the displacement limitation 86 is removed.

It is to be understood that the present invention is not limited to the embodiments described above and illustrated in the drawings; rather, the skilled person will recognize that many changes and modifications may be made within the scope of the appended claims.

The invention claimed is:

1. A method of controlling a rotatable load by a hydraulic system, the hydraulic system comprising a high-pressure side; a low-pressure side; a variable displacement hydraulic machine for rotationally driving the rotatable load; and a valve arrangement in fluid communication with the high-pressure side, the low-pressure side, a first side of the hydraulic machine, and a second side of the hydraulic machine; wherein the method comprises:

determining when the hydraulic system is in a first operating state or a second operating state, the determination being based at least on one of a commanded or actual rotational speed of the hydraulic machine, a commanded or actual torque of the hydraulic machine, and/or a commanded or actual power of the hydraulic machine;

controlling the rotatable load in a valve control mode when the hydraulic system is in the first operating state, the valve control mode comprising controlling the rotatable load by controlling the valve arrangement;

controlling the rotatable load in a displacement control mode when the hydraulic system is in the second operating state, the displacement control mode comprising controlling the rotatable load mainly by controlling the displacement of the hydraulic machine; and applying a non-zero absolute minimum displacement limitation to the hydraulic machine at least in the valve control mode.

2. The method according to claim 1, wherein the displacement limitation in the valve control mode and/or a displacement of the hydraulic machine in the valve control mode is at least 60%.

3. The method according to claim 1, further comprising:

applying the displacement limitation to the hydraulic machine at least when a rotational speed of the hydraulic machine is below a first speed threshold value, when a power of the hydraulic machine is below a first power threshold value, and/or when a torque of the hydraulic machine is below a first torque threshold value;

determining a required displacement of the hydraulic machine based on a command for the hydraulic machine and a pressure drop over the hydraulic machine;

determining that the hydraulic system is in the first operating state when the required displacement is smaller than the displacement limitation of the hydraulic machine; and determining that the hydraulic system is in the second operating state when the required displacement is larger than the displacement limitation of the hydraulic machine.

4. The method according to claim 3, further comprising reducing or eliminating the displacement limitation of the hydraulic machine, or maintaining a constant displacement limitation of the hydraulic machine, when the rotational speed of the hydraulic machine is above a second speed threshold value, higher than or equal to the first speed threshold value, when the power of the hydraulic machine is above a second power threshold value, higher than or equal to the first power threshold value, and/or when the torque of the hydraulic machine is above a second torque threshold value, higher than or equal to the first torque threshold value.

5. The method according to claim 3, further comprising reducing the displacement limitation of the hydraulic machine when the rotational speed of the hydraulic machine increases from the first speed threshold value, when the power of the hydraulic machine increases from the first power threshold value, and/or when the torque of the hydraulic machine increases from the first torque threshold value.

6. The method according to claim 3, further comprising determining the pressure drop over the hydraulic machine based on a pressure difference between the high-pressure side and the low-pressure side.

7. The method according to claim 1, wherein a pressure difference between the first side and the second side is smaller in the valve control mode than in the displacement control mode.

8. The method according to claim 1, further comprising switching a fluid communication between the high-pressure side and the first side to a fluid communication between the high-pressure side and the second side by means of the valve arrangement.

9. The method according to claim 1, wherein the rotatable load is entirely controlled by controlling the displacement of the hydraulic machine in the displacement control mode.

10. The method according to claim 1, further comprising controlling the displacement of the hydraulic machine by means of closed loop control in the displacement control mode.

11. The method according to claim 1, wherein the control of the rotatable load comprises controlling one of torque, rotational position, rotational speed, and rotational acceleration of the rotatable load.

12. The method according to claim 1, wherein the hydraulic machine is a two-quadrant hydraulic machine operative as a pump and as a motor.

13. The method according to claim 1, wherein the displacement limitation in the valve control mode and/or a displacement of the hydraulic machine in the valve control mode is at least 80%.

14. The method according to claim 1, wherein the displacement limitation in the valve control mode and/or a displacement of the hydraulic machine in the valve control mode is 100%.

15. A hydraulic system for controlling a rotatable load, the hydraulic system comprising:

a high-pressure side;

a low-pressure side;

a variable displacement hydraulic machine for rotationally driving the rotatable load; and a valve arrangement in fluid communication with the high-pressure side, the low-pressure side, a first side of the hydraulic machine and a second side of the hydraulic machine;

wherein the hydraulic system further comprises a control system configured to:

determine when the hydraulic system is in a first operating state or a second operating state, the determination being based at least on one of a commanded or actual rotational speed of the hydraulic machine, a commanded or actual torque of the hydraulic machine, and/or a commanded or actual power of the hydraulic machine;

control the rotatable load in a valve control mode when the hydraulic system is in the first operating state, the valve control mode comprising controlling the rotatable load by controlling the valve arrangement;

control the rotatable load in a displacement control mode when the hydraulic system is in the second operating state, the displacement control mode comprising controlling the rotatable load mainly by controlling the displacement of the hydraulic machine; and applying a non-zero absolute minimum displacement limitation to the hydraulic machine at least in the first operating state.

16. The hydraulic system according to claim 15, wherein the displacement limitation in the first operating state and/or a displacement of the hydraulic machine in the first operating state is at least 60%.

17. The hydraulic system according to claim 15, wherein the control system is configured to:

apply the displacement limitation to the hydraulic machine at least when a rotational speed of the hydraulic machine is below a first speed threshold value, when a power of the hydraulic machine is below a first power threshold value and/or when a torque of the hydraulic machine is below a first torque threshold value;

determine a required displacement of the hydraulic machine based on a command for the hydraulic machine and a pressure drop over the hydraulic machine; and determine that the hydraulic system is in the first operating state when the required displacement is smaller than the displacement limitation of the hydraulic machine; and determine that the hydraulic system is in the second operating state when the required displacement is larger than the displacement limitation of the hydraulic machine.

18. The hydraulic system according to claim 17, wherein the control system is configured to reduce or eliminate the displacement limitation of the hydraulic machine, or maintain a constant displacement limitation of the hydraulic machine, when the rotational speed of the hydraulic machine is above a second speed threshold value, higher than or equal to the first speed threshold value, when the power of the hydraulic machine is above a second power threshold value, higher than or equal to the first power threshold value, and/or when the torque of the hydraulic machine is above a second torque threshold value, higher than or equal to the first torque threshold value.

19. The hydraulic system according to claim 17, wherein the control system is configured to gradually reduce the displacement limitation of the hydraulic machine when the rotational speed of the hydraulic machine increases from the first speed threshold value, when the power of the hydraulic machine increases from the first power threshold value, and/or when the torque of the hydraulic machine increases from the first torque threshold value.

20. The hydraulic system according to claim 17, wherein the control system is configured to determine the pressure drop over the hydraulic machine based on a pressure difference between the high-pressure side and the low-pressure side.

21. The hydraulic system according to claim 15, wherein the control system is configured to control the valve arrangement to switch a fluid communication between the high-pressure side and the first side to a fluid communication between the high-pressure side and the second side.

22. The hydraulic system according to claim 15, wherein the control system is configured to control the rotatable load entirely by controlling the displacement of the hydraulic machine in the displacement control mode.

23. The hydraulic system according to claim 15, wherein the displacement limitation in the valve control mode and/or a displacement of the hydraulic machine in the valve control mode is at least 80%.

24. The hydraulic system according to claim 15, wherein the displacement limitation in the valve control mode and/or a displacement of the hydraulic machine in the valve control mode is 100%.

* * * * *